US005166729A

United States Patent [19]

Rathbun et al.

[11] Patent Number: 5,166,729

[45] Date of Patent: Nov. 24, 1992

[54] TONER CONCENTRATION SENSING APPARATUS

[75] Inventors: Darrel R. Rathbun; Michael D. Borton, both of Ontario; John Buranicz, Cohoes, all of N.Y.

[73] Assignee: Xerox Corporation, Stamford, Conn.

[21] Appl. No.: 753,144

[22] Filed: Aug. 30, 1991

[51] Int. Cl.[5] ..... G03G 21/00

[52] U.S. Cl. ..... 355/208; 118/689; 324/445; 324/654; 355/203; 355/246

[58] Field of Search ..... 324/445, 654; 355/203, 355/204, 205, 206, 208, 246; 118/689

[56] References Cited

U.S. PATENT DOCUMENTS

| | | | |
|---|---|---|---|
| 3,355,661 | 11/1967 | Nonaka | 324/445 |
| 3,572,551 | 3/1971 | Gillespie | 222/56 |
| 3,698,926 | 10/1972 | Furuichi | 117/17.5 |
| 3,707,134 | 12/1972 | Gawron | 118/7 |
| 3,802,381 | 4/1974 | O'Neill et al. | 118/7 |
| 3,970,036 | 7/1976 | Baer et al. | 118/7 |
| 4,342,283 | 8/1982 | Terashima | 118/689 |
| 4,706,032 | 11/1987 | Allen et al. | 355/203 X |

FOREIGN PATENT DOCUMENTS 1270965 4/1972 United Kingdom .

OTHER PUBLICATIONS

Xerox Disclosure Journal Toner Concentration Meter vol. 5 US #3 May 1980–Jun. 1980.

*Primary Examiner*—A. T. Grimley
*Assistant Examiner*—J. E. Barlow, Jr.
*Attorney, Agent, or Firm*—Gary B. Cohen

[57] ABSTRACT

In accordance with the present invention an apparatus is provided for use with a developer container adapted to retain a quantity of developer material, the developer material including varying concentrations of magnetic carrier material and toner material. The toner concentration sensing apparatus comprises a device for generating a magnetic field within the developer container. The apparatus further comprises a device for controlling the generating device to selectively generate the magnetic field within the developer container, wherein a preselected portion of the developer material is compressed by the magnetic field and a signal is generated across the generating device, the signal across the generating device varying as a function of the concentration of the toner.

25 Claims, 9 Drawing Sheets

TONER CONCENTRATION SENSING APPARATUS

BACKGROUND OF THE INVENTION

1. Field of the Invention

The present invention relates generally to an apparatus for sensing toner concentration in a container of developer material, and more particularly to a technique employing an active magnetic force to compress a preselected volume of developer material so that a representative permeability measurement of the developer material in the container can be obtained.

2. Description of the Prior Art

In an electrophotographic printing machine, the photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing marking or toner particles into contact therewith. This forms a powder image on the photoconductive member which is subsequently transferred to a copy sheet. The copy sheet is heated to permanently affix the marking particles thereto in image configuration.

Various types of development systems have hereinbefore been employed. These systems utilize two component developer mixes or single component developer materials. Typical two component developer mixes employed are well known in the art, and generally comprise dyed or colored thermoplastic powders, known in the art as toner particles, which are mixed with coarser carrier granules, such as ferromagnetic granules. The toner particles and carrier granules are selected such that the toner particles acquire the appropriate charge relative to the electrostatic latent image recorded on the photoconductive surface. When the developer mix is brought into contact with the charged photoconductive surface the greater attractive force of the electrostatic latent image recorded thereon causes the toner particles to transfer from the carrier granules and adhere to the electrostatic latent image.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner particles of a color complimentary thereto. This process is repeated a plurality of cycles for differently colored images and their respective complimentarily colored toner particles. For example, a red filtered light image is developed with cyan toner particles, while a green filtered light image is developed with magenta toner particles and a blue filtered light image with yellow toner particles. Each single color toner powder image is transferred to the copy sheet superimposed over the prior toner powder image. This creates a multi-layered toner powder image on the copy sheet. Thereafter, the multi-layered toner powder image is permanently affixed to the copy sheet creating a color copy. An illustrative electrophotographic printing machine for producing color copies is the Model No. 1005 made by the Xerox Corporation.

It is evident that in printing machines of this type, toner particles are depleted from the developer mixture. As the concentration of toner particles decreases, the density of the resultant copy degrades. In order to maintain the copies being reproduced at a specified minimum density, it is necessary to regulate the concentration of toner particles in the developer mixture. Moreover, sensing of toner concentration provides valuable input for process control of the electrophotographic printing machine. Toner concentration can be regulated by various known techniques, one of which includes monitoring an electro-magnetic property of the developer, such as permeability, permittivity or conductivity, to obtain information regarding the carrier-toner ratio. The following references may be of pertinence to the present disclosure:

U.S. Pat. No. 3,572,551
Patentee: Gillespie
Issued: Mar. 30, 1971

U.S. Pat. No. 3,698,926
Patentee: Furuichi
Issued: Oct. 17, 1972

U.S. Pat. No. 3,707,134
Patentee: Gawron
Issued: Dec. 26, 1972

U.S. Pat. No. 3,802,381
Patentee: O'Neill et al.
Issued: Apr. 9, 1974

U.S. Pat. No. 3,970,036
Patentee: Baer et al.
Issued: Jul. 20, 1976

Tso, T.T.
Toner Concentration Meter
Xerox Disclosure Journal, Vol. 5, No. 3 at p. 315
Published: May/June 1980

The above-cited references can be summarized as follows:

U.S. Pat. No. 3,572,551 discloses an apparatus for monitoring and controlling the concentration of toner in a developer mix. The method implemented by the apparatus comprises the steps of (1) passing samples of the developer mix past, and adjacent, a coil connected in an AC circuit, whereby the inductance of the coil varies as a function of the concentration of the toner in the samples of the mix and the AC circuit provides output signals which vary with the concentration of the toner in the samples, and (2) comparing the output signals to the reference signals of known concentrations of toner in the mix, whereby the concentration of toner in the samples is determinable.

U.S. Pat. No. 3,698,926 discloses a method and apparatus for supplementing toner in electrophotographic machines. The apparatus comprises a source of toner, a container containing a developing agent for applying the same onto latent images, a movable impedance element which varies its impedance in accordance with the percentage content of the toner in the developing agent and means responsive to the variation in the impedance of the variable impedance element to supply the toner to the container from the source so as to maintain the percentage content of the toner at a constant level.

U.S. Pat. No. 3,707,134 discloses an apparatus for monitoring and controlling the ratio of toner-to-carrier particles of a developer mix comprising an inductive sensing coil having an iron core. The coil is placed in the surroundings of a developer apparatus of an electrostatic copying machine so as to be in contacting relation with the developer mix containing toner and magnetizable carrier particles. The inductive reactance of the coil is a function of the amount of magnetizable particles per toner particles in the mix. Thus, as the toner is depleted, the inductance of the coil changes. The frequency of an oscillator circuit connected to the coil changes as the inductance of the coil is varied. The change in frequency produces a corresponding output of additional circuitry which in turn operates a toner dispenser unit, causing toner to be added to the mix to restore the toner-to-carrier ratio to a predetermined level.

U.S. Pat. No. 3,802,381 discloses an apparatus for measuring the ratio of ferromagnetic carrier particles to toner particles in an electrostatic printing machines. Generally, an electric or magnetic field is established in the area of a quantity of developer mix and a measurement of a parameter, such as magnetic permeability, is employed to indicate the need for a greater or lesser percentage of toner or carrier in the mix. In the preferred embodiment of the disclosed invention, a trough, located in the path of movement of mix within the printing machine, provides a build-up of mix in which one of the fields may be established. In one aspect of the disclosed invention, first and second coils are positioned in the trough, the coils being disposed in air or wrapped about a core. The first and second coils are respectively coupled to an AC generator and an AC meter. In operation, a magnetic field is established in the trough so that magnetic permeability, an indicator of toner concentration, can be measured as the mix flows through the trough.

U.S. Pat. No. 3,970,036 discloses a toner concentration detector in which developer removed from a photoreceptive member after developing is directed through a duct. A coil surrounding the duct comprises an element of a sensing oscillator, the frequency of which is compared with that of a tunable reference oscillator to provide a frequency difference signal, which signal is a measure of the relative proportion of toner to carrier in the developer. This toner concentration signal is employed to actuate a toner replenishing system to feed toner from a supply of toner to a developer.

The Xerox Disclosure Journal discloses a toner concentration meter system comprising a tube located in the air core of a transformer. In operation, the primary windings of the transformer are excited with an alternating current to produce an alternating current output in the secondary windings. The secondary windings are coupled with a tuned secondary circuit having a characteristically sharp resonance point. Since' the resonant frequency varies with toner concentration, the concentration of a given developer can be determined by suitable adjustment of the driving frequency of the system.

Except for U.S. Pat. No. 3,707,134, the above references disclose a "passive" magnetic sensors that are capable of determining toner concentration by measuring the magnetic permeability of developer flowing through a tube or the like. It has been found that such passive sensors have a sensitivity to developer flow variations, and accordingly are subject to undesirable levels of "noise" or error. Other problems, such as developer aging, non-geometric packing fractions and changes in the environment can also have an adverse effect on the performance of such passive sensors.

While the sensing arrangement of U.S. Pat. No. 3,707,134 ('134 patent) avoids some of the above-mentioned problems, it is relatively complex in design, and can yield inaccurate results. In particular, the sensor of this arrangement is positioned adjacent a magnetic brush and can thus become contaminated by stray developer material. Moreover, unless the layer of developer on the brush is closely metered, inaccurate toner concentration readings can be obtained. Finally, the circuitry for the arrangement of the '134 patent includes many components, and is thus relatively expensive to manufacture.

It would be desirable to provide a sensing apparatus that is capable of measuring magnetic permeability of developer material without being subjected to undesirable levels of noise. Moreover, it would be desirable to provide a relatively inexpensive sensing apparatus that is both easy to implement and free from a contaminating environment.

SUMMARY OF THE INVENTION

In accordance with the present invention an apparatus is provided for use with a developer container adapted to retain a quantity of developer material, the developer material including varying concentrations of magnetic carrier material and toner material. The toner concentration sensing apparatus comprises means for generating a magnetic field within the developer container. The apparatus further comprises means for controlling the generating means to selectively generate the magnetic field within the developer container, wherein a preselected portion of the developer material is compressed by the magnetic field and a signal is generated across the generating means, the signal across the generating means varying as a function of the concentration of the toner material.

In one aspect of the disclosed embodiment, the apparatus further comprises means for directing magnetic field lines of the magnetic field, wherein substantially all of the field lines are directed from the generating means into the developer container to form a strong local magnetic field within the developer container. In the preferred embodiment, the directing means comprises a shield encompassing a substantial portion of the generating means.

In another aspect of the disclosed embodiment, the developer container comprises a developer housing. The developer housing defines a chamber adapted to contain the developer material and has a wall surrounding the chamber. Preferably, the generating means is mounted on an outer surface of the developer housing wall so that the generating means is spaced from the chamber.

In yet another aspect of the disclosed embodiment, the magnetic field is generated for a preselected interval and the signal across the generating means is a current output, the current output decaying about after the preselected interval has ended at a rate varying as a function of toner concentration. Preferably, the monitoring means includes means for processing the decaying current output to determine when the decaying current output has attained a preselected threshold level.

Numerous features of the present invention will be appreciated by those skilled in the art.

One feature of the present invention is that the sensing apparatus is highly insensitive to various key environmental and physical constraints, such as fluctuation in both humidity and tribo-electric charge, developer aging and non-geometric packing fractions. In great part, this high level of insensitivity is due to the ability of the sensing apparatus to compress the preselected volume of developer material so that magnetic permeability can be measured accurately, notwithstanding substantial changes in the above-mentioned constraints.

Another feature of the present invention is that the sensing apparatus can be constructed with a minimum amount of components, the components being relatively inexpensive. Moreover the sensing apparatus has a simple design and is easy to manufacture.

Yet another feature of the present invention is that a strong local magnetic field can be generated economically in the developer container. In particular, magnetic field lines are directed into the developer container by use of the shield so that the magnetic field outside of the magnetic field generating means and the developer container is minimized.

Yet another feature of the present invention is that the magnetic field generating means can be mounted on an outer surface of the developer container without affecting the effectiveness of the magnetic field generating means. Consequently, there is neither a need to physically alter the structure of the developer container nor to contaminate the magnetic field generating means by disposing it in direct contact with the developer material.

Another feature of the present invention is that the output of the magnetic field generating means can be discretized by use of a digital processing means. With discretized output in the form of a count, toner concentration can be determined by way of digital processing. For example, a count representing the toner concentration in the developer container can be converted into a toner concentration percentage with the aid of a look-up table, the look-up table having counts referenced with toner concentration percentages.

These and other aspects of the invention will become apparent from the following description, the description being used to illustrate a preferred embodiment of the invention when read in conjunction with the accompanying drawings.

DESCRIPTION OF A PREFERRED EMBODIMENT OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
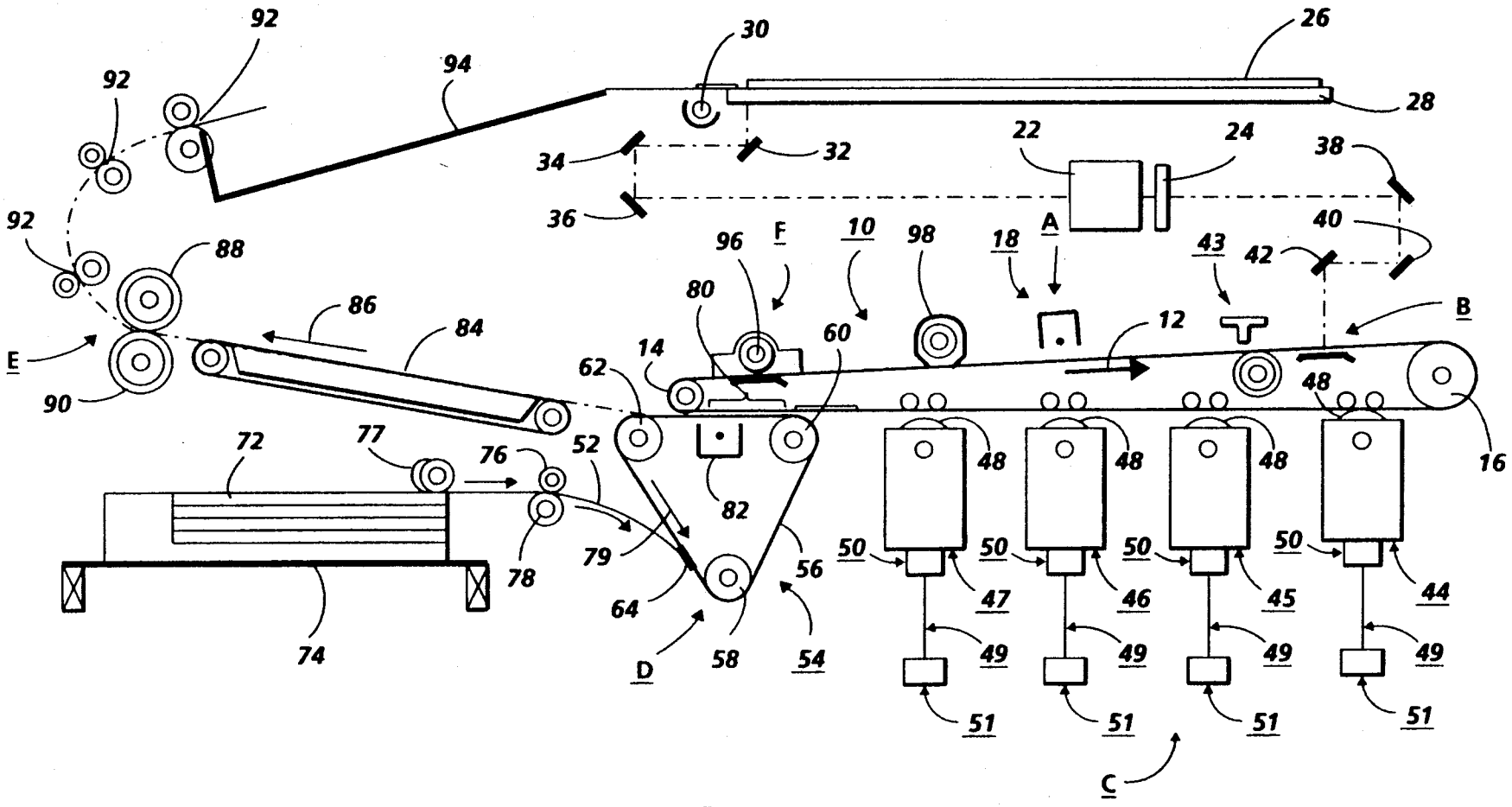
FIG. 1 is a schematic elevational view depicting an electrophotographic printing machine incorporating the toner concentration sensing apparatus of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating a toner concentration sensing apparatus of the present invention therein. It will become evident from the following discussion that the sensing apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoreceptor, i.e. a photoconductive belt 10. Preferably, the photoconductive belt 10 is made from a photoconductive material coated on a grounding layer, which, in turn, is coated on an anti-curl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed. Belt 10 moves in the direction of arrow 12 to advance successive portions of the photoconductive surface sequentially through the various processing stations disposed about the path of movement thereof. Belt 10 is entrained about idler roller 14 and drive roller 16. Idler roller 14 is mounted rotatably so as to rotate with belt 10. Drive roller 16 is rotated by a motor coupled thereto by suitable means such as a belt drive. As roller 16 rotates, it advances belt 10 in the direction of arrow 12.

Initially, a portion of photoconductive belt 10 passes through charging station A. At charging station A, a corona generating device, indicated generally by the reference numeral 18 charges photoconductive belt 10 to a relatively high, substantially uniform potential.

Next, the charged photoconductive surface is rotated to exposure station B. Exposure station B includes a moving lens system, generally designated by the reference numeral 22, and a color filter mechanism, shown generally by the reference numeral 24. An original document 26 is supported stationarily upon a transparent viewing platen 28. Successive incremental areas of the original document are illuminated by means of a moving lamp assembly, shown generally by the reference numeral 30. Mirrors 32, 34 and 36 reflect the light rays through lens 22. Lens 22 is adapted to scan successive areas of illumination of platen 28. The light rays from lens 22 are transmitted through filter 24 and reflected by mirrors 38, 40, and 42 on to the charged portion of photoconductive belt 10. Lamp assembly 30, mirrors 32, 34 and 36, lens 22, and filter 24 are moved in a timed relationship with respect to the movement of photoconductive belt 10 to produce a flowing light image of the original document on photoconductive belt 10 in a non-distorted manner. During exposure, filter mechanism 24 interposes selected color filters into the optical light path of lens 22. The color filters operate on the light rays passing through the lens to record an electrostatic latent image, i.e. a latent electrostatic charge pattern, on the photoconductive belt corresponding to a specific color of the flowing light image of the original document. Exposure station B also includes a test area generator, indicated generally by the reference numeral 43, comprising a light source to project a test light image onto the charged portion of the photoconductive surface in the inter-image region, i.e. the region between successive electrostatic latent images recorded on photoconductive belt 10, to record a test area. The test area, as well as the electrostatic latent image recorded on the photoconductive surface of belt 10 are developed with toner particles at a development station C.

After the electrostatic latent image and test area have been recorded on photoconductive belt 10, belt 10 advances them to the development station C. Development station C includes four individual developer units generally indicated by the reference numerals 44–47. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush 48 of developer material. The developer particles are continually moving so as to provide the brush 48 consistently with fresh developer material. Development is achieved by bringing the brush 48 of developer material into contact with the photoconductive surface. Developer units 44–47, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum corresponding to the wave length of light transmitted through the filter. For example, an electrostatic latent image formed by passing the light image through a green filter will record the red and blue portions of the spectrums as areas of relatively high charge density on photoconductive belt 10, while the green light rays will pass through the filter and cause the charge density on the photoconductive belt 10 to be reduced to a voltage level ineffective for development. The charged areas are then made visible by having developer unit 44 apply green absorbing (magenta) toner particles onto the electrostatic latent image recorded on photoconductive belt 10. Similarly, a blue separation is developed by developer unit 45 with blue absorbing (yellow) toner particles, while the red separation is developed by developer unit 46 with red absorbing (cyan) toner particles. Developer unit 47 contains black toner particles and may be used to develop the electrostatic latent image formed from a black and white original document. The yellow, magenta and cyan toner particles are diffusely reflecting particles. Each of the developer units 44–47 is moved into and out of the operative position. In the operative position, the magnetic brush 48 is closely adjacent the photoconductive belt, while, in the non-operative position, the magnetic brush 48 is spaced therefrom. During development of each electrostatic latent image only one developer unit is in the operative position, the remaining developer units are in the non-operative position. This insures that each electrostatic latent image and successive test areas are developed with toner particles of the appropriate color without co-mingling. In FIG. 1, developer unit 44 is shown in the operative position with developer units 45–47 being in the non-operative position. For each of the developers 44–47 toner concentration decreases as toner particles are applied to the photoreceptor 10. To maintain desirable levels of toner concentration in developer units 44–47, it is necessary to know when the toner concentration has fallen below a predetermined level. Accordingly, each of the developer units 44–47 is provided with a sensing apparatus 49, the sensing apparatus including a sensing head or sensor 50 coupled with a driving/processing network 51. The structure and operation of the sensing apparatus 49 will be described in further detail below.

After development, the toner image is moved to transfer station D where the toner image is transferred to a sheet of support material 52, such as plain paper amongst others. At transfer station D, the sheet transport apparatus, indicated generally by the reference numeral 54, moves sheet 52 into contact with photoconductive belt 10. Sheet transport 54 has a pair of spaced belts 56 entrained about three rolls 58, 60 and 62. A gripper 64 extends between belts 56 and moves in unison therewith. Sheet 52 is advanced from a stack of sheets 72 disposed on tray 74. Feed roll 77 advances the uppermost sheet from stack 72 into the nip defined by forwarding rollers 76 and 78. Forwarding rollers 76 and 78 advance sheet 52 to sheet transport 54. Sheet 52 is advanced by forwarding rollers 76 and 78 in synchronism with the movement of gripper 64. In this way, the leading edge of sheet 52 arrives at a preselected position to be received by the open gripper 64. The gripper 64 then closes, securing the sheet thereto for movement therewith in a recirculating path. The leading edge of the sheet is secured releasably by gripper 64. As the belts move in the direction of arrow 79, the sheet 52 moves into contact with the photoconductive belt, in synchronism with the toner image developed thereon, at a transfer zone 80. A corona generating device 82 sprays ions onto the backside of the sheet so as to charge the sheet to the proper magnitude and polarity for attracting the toner image from photoconductive belt 10 thereto. Sheet 52 remains secured to gripper 64 so as to move in a recirculating path for three cycles. In this way, three different color toner images are transferred to sheet 52 in superimposed registration with one another. Thus, the aforementioned steps of charging, exposing, developing, and transferring are repeated a plurality of cycles to form a multi-color copy of a colored original document.

After the last transfer operation, grippers 64 open and release sheet 52. Conveyor 84 transports sheet 52, in the direction of arrow 86, to fusing station E where the transferred image is permanently fused to sheet 52. Fusing station E includes a heated fuser roll 88 and a pressure roll 90. Sheet 52 passes through the nip defined by fuser roll 88 and pressure roll 90. The toner image contacts fuser roll 88 so as to be affixed to sheet 52. Thereafter, sheet 52 is advanced by forwarding roll pairs 92 to catch tray 94 for subsequent removal therefrom by the machine operator.

The last processing station in the direction of movement of belt 10, as indicated by arrow 12, is cleaning station F. A rotatably mounted fibrous brush 96 is positioned in cleaning station F and maintained in contact with photoconductive belt 10 to remove residual toner particles remaining after the transfer operation. Thereafter, lamp 98 illuminates photoconductive belt 10 to remove any residual charge remaining thereon prior to the start of the next successive cycle.

Figure 2:
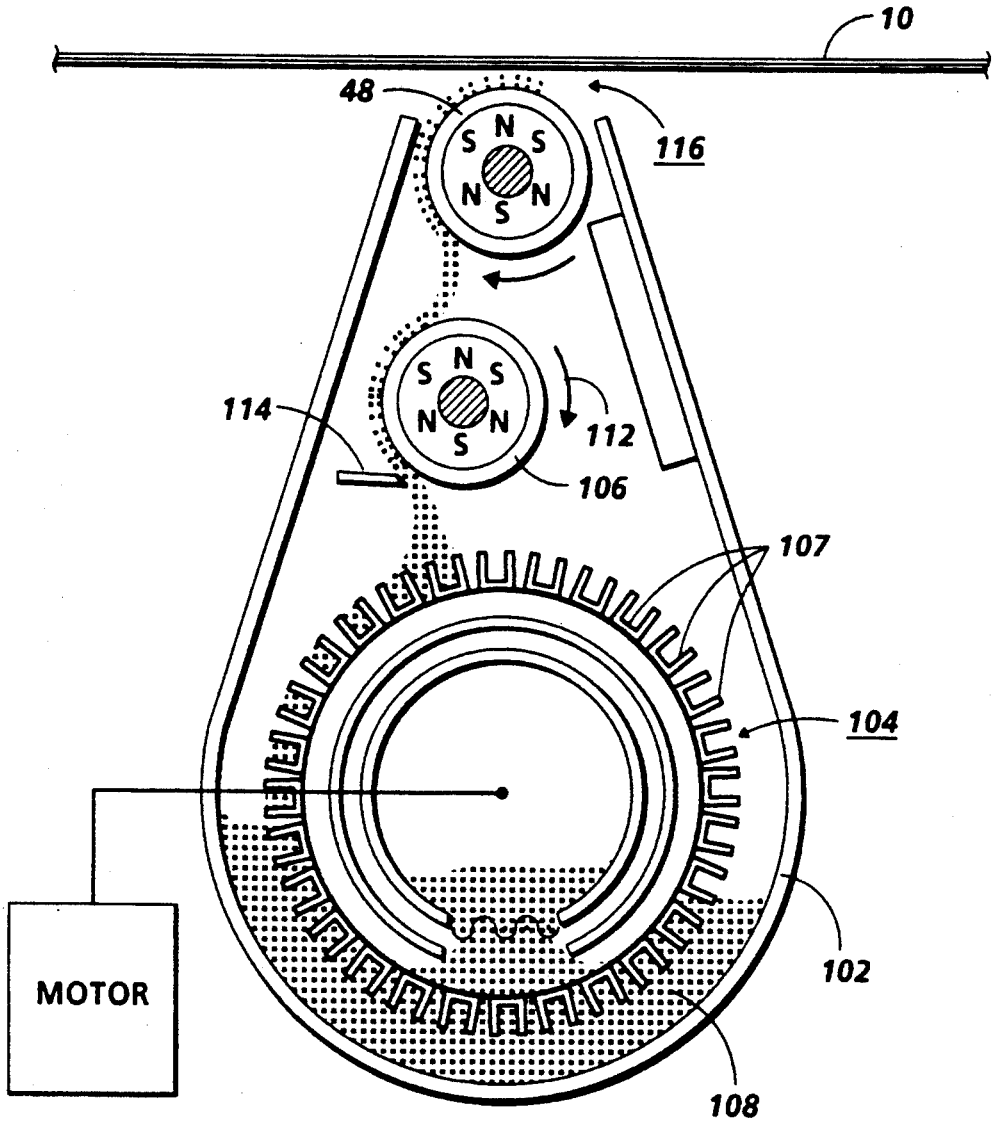
FIG. 2 is a sectional view of a developer unit preferably used in the electrophotographic printing machine.

Referring to FIG. 2, the structure and operation of the developer units 44–47 will be discussed in further detail. Since the structure and operation of each of the developer units 44–47 is identical, only the structure and operation of developer unit 44 will be described. As will be appreciated by those skilled in the art, the developer unit 44 described is merely exemplary of one of many types of developing arrangements that could be employed to implement the present invention. The principle components of the developer unit 44 are a developer housing 102, a paddle wheel 104, a doner roll 106 and the magnetic brush 48. Paddle wheel 104 is a cylindrical member with buckets or scoops 107 disposed about the periphery thereof, the paddle rotating to elevate developer mix 108 from a lower part of the developer housing 102 to an upper region thereof. When the developer mix 108 reaches the upper region of the housing 102, it is lifted from buckets 107 to the donor roll 106.

As developer mix 108, in the buckets 107, approaches the donor roll 106, the magnetic field produced by the fixed magnets therein attract developer mix 108. The donor roll 106 moves developer mix 108 in an upward direction as the donor roll 106 is rotated in a direction consistent with arrow 112. Since a surplus of developer mix may be furnished to the donor roll 106 from paddle wheel 104, a metering blade 114 is provided to control the amount of developer mix carried over the top of the donor roll 106. The blade 114 is positioned to shear surplus developer mix 108 from the donor roll 106 so that surplus developer mix 108 falls in a downward direction toward the paddle wheel 104. The developer mix 108, which passes the metering blade 114, is carried over the donor roll 106 and into a development zone 116 located between the surface of photoreceptor 10 and the magnetic brush 48. The electrostatic latent image recorded on the photoreceptive surface is developed by contacting the moving developer mix 108 with the surface of the photoconductive belt 10. The charged areas of the photoconductive belt surface electrostatically attract toner particles from the carrier granules of the developer mix 108. During the development process, surplus carrier granules and toner particles from the developer mix 108 fall to the bottom part of the developer housing 102, and are continually mixed thereat in a manner consistent with the teachings of U.S. Pat. No. 3,960,444 (Patentee: Gundlach et al.), the pertinent portions of which are incorporated herein by reference.

Figure 3:
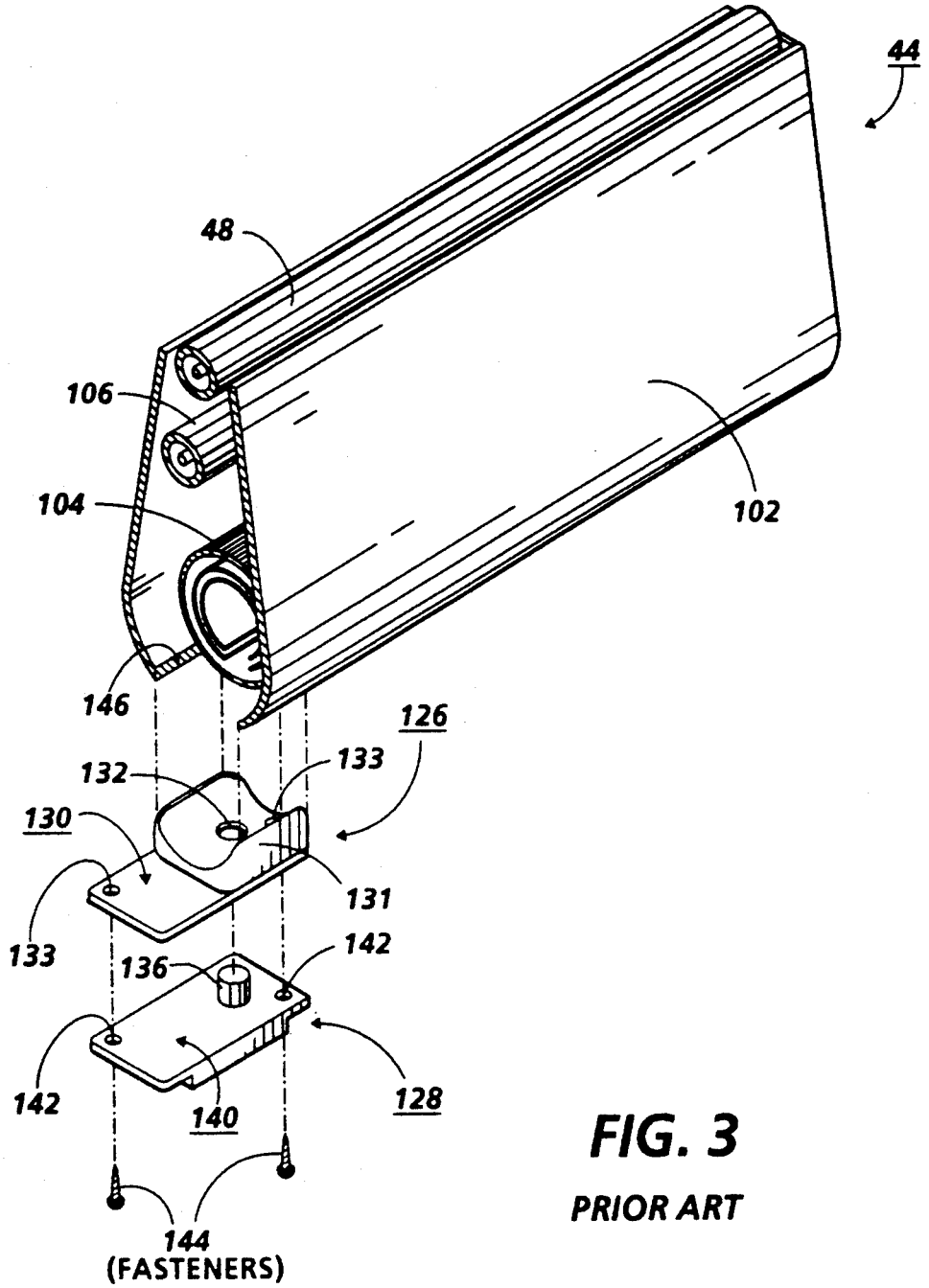
FIG. 3 PRIOR ART
FIG. 3 is a prior art arrangement including a sectional view of the developer unit with an exploded, perspective view of a known toner concentration sensing arrangement.

Referring to FIG. 3, a known sensing arrangement of the type manufactured by TDK under the catalog number TSO524LB-X, is shown mounted to the developer housing 102. The sensing arrangement comprises a mounting unit 126 and a sensing apparatus 128. The mounting unit 126 includes an elongate mounting member 130, the mounting member 130 having a head portion 131. The head portion 131 conforms in shape to a bottom portion of the developer housing 102. Apertures 132–133 are defined in the unit 126. The sensing apparatus 128 comprises a sensor head 136 coupled with sensing circuitry (not shown), both of which are secured in a housing 140. The housing 140 defines apertures 142 which are capable of receiving fasteners 144. Preferably, the sensor head 136 is cylindrically shaped, and its outer diameter is just less than the inner diameter of aperture 132.

In a known embodiment, the sensing arrangement 118 is mounted to a bottom surface of the developer housing 102 by first drilling an aperture or slot 146 in a bottom wall of the developer housing 120 and fitting the head portion 131 into the aperture 146. After fitting the head portion 131 conformingly with the aperture 146, the sensing head 136 is inserted through the apertures 132,146. The apertures 133 are then aligned with apertures 142, and the housing 140 is mounted to mounting member 130 by use of fasteners 144. Preferably, when the sensor head 136 is inserted through the apertures 132,146, it is in contact with the developer material in the housing 140.

Figure 4:
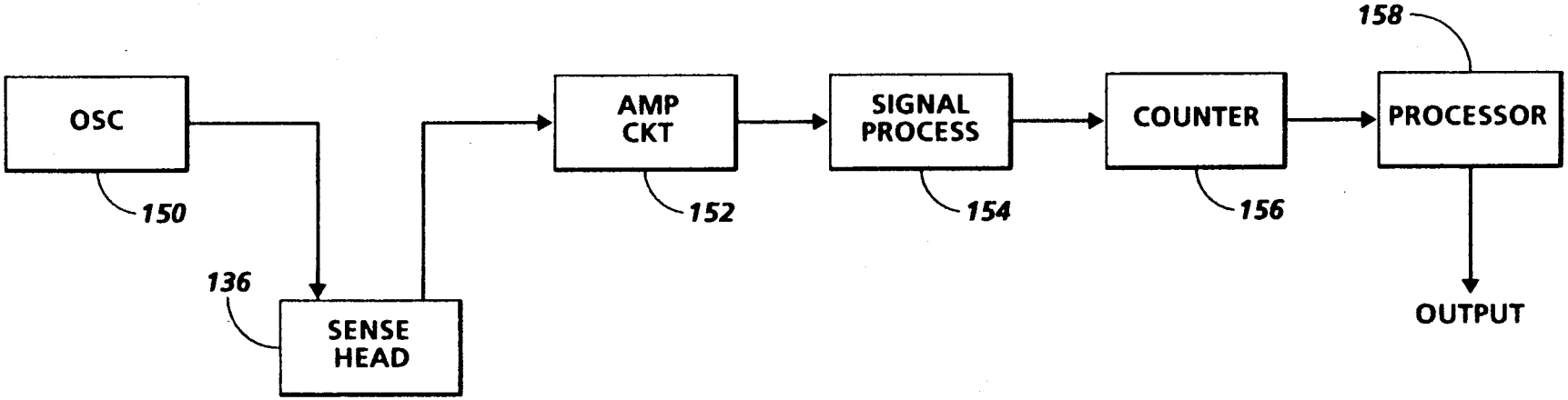
FIG. 4 is a schematic view of a circuit used in the known sensing arrangement.

Referring to FIG. 4, an exemplary circuit, which could be employed to implement the sensing circuitry, is shown in schematic form. As shown in FIG. 4, the sensing head 136 is preferably driven by an oscillator 150, and the resulting output of the sensing head 136 can be amplified at an amplifying subcircuit 152. The resulting amplified signal is processed into pulses at a signal processing subcircuit 154, and those pulses are counted at a counting subcircuit 156. The counted pulses can then be converted into a signal output, having a magnitude and frequency, by way of a processing circuit 158.

In operation, developer mix flows by the sensing head 136 while the frequency and magnitude of the signal generated thereat varies as a function of the magnetic permeability of the developer mix. As toner is depleted in the developer, the magnetic permeability increases and thereby deceases both the frequency and magnitude of the signal output. Through use of standard calibration techniques, the various frequencies or magnitudes of the signal output can, for a given operating point, be correlated into corresponding toner concentration values.

It has been found, through experimentation, that this technique provides a precise and accurate of toner concentration measurement as long as certain conditions, such as environment, developer age, tribo-electric charge, flow and packing, are held constant. As any one of these conditions is altered, however, the operating point changes, and the calibration of the system is shifted accordingly. For example, over a given time interval, such as a day, the tribo-electric charge of a developer mix can increase noticeably. As the tribo-electric charge increases, the operating point, and thus the calibration curve, of the sensing apparatus 128 shifts so that the relationship of signal output magnitude to toner concentration is no longer the same. Unless the sensing apparatus 128 is adjusted suitably to accommodate for the new operating point, undesirable error in toner concentration determinations is encountered. As will be appreciated by those skilled in the art, constantly adjusting the sensing apparatus 128 is hardly feasible since the sensing apparatus 128 is typically inaccessible to users other than a serviceperson.

Figure 5A:
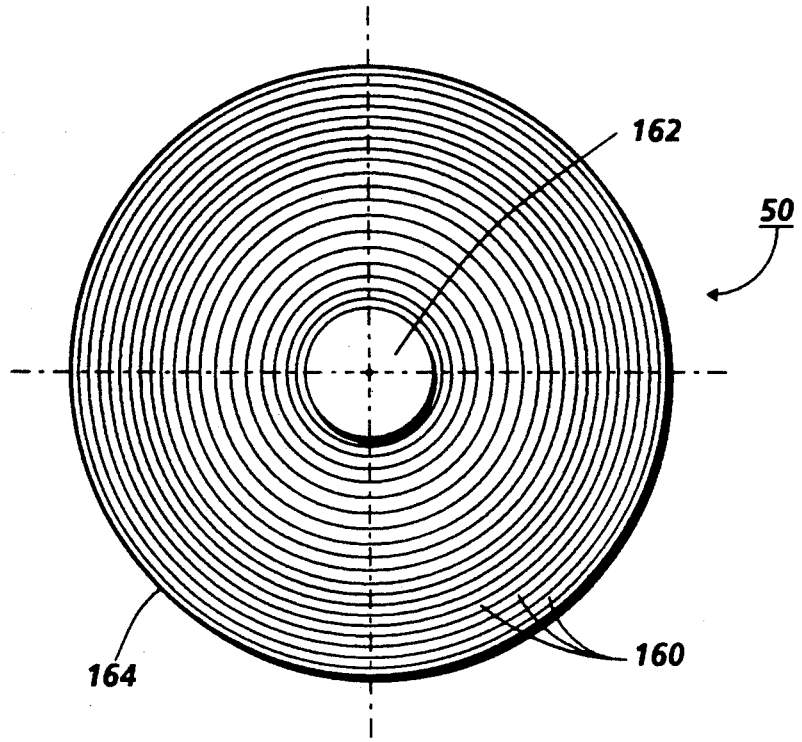
FIG. 5A depicts a top plan view of a sensing head used in the sensing apparatus of the present invention.
Figure 5B:
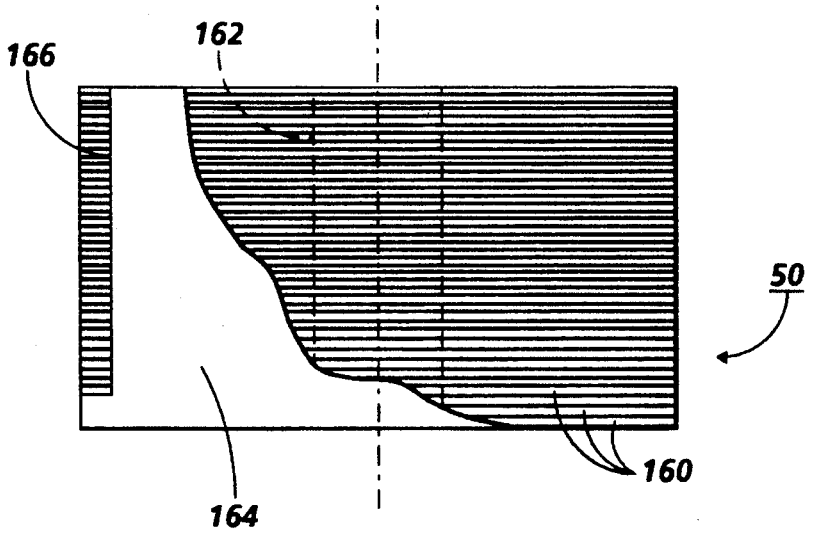
FIG. 5B depicts a side elevational view of the sensing head.

As will be discussed in further detail below, the sensing apparatus 49, in contrast to the known sensing apparatus 118, is highly insensitive to the above-noted condition changes. Referring specifically to FIGS. 5A and 5B, the sensing head or sensor 50 of the sensing apparatus 49 is shown in further detail. In the preferred embodiment, the sensing head 50 comprises wire 160 wrapped around a core 162. While the core 162 can be an air core, in the preferred embodiment the core 162 comprises a steel core. A substantial portion of the sensing head 50 is encompassed by a shield 164, the shield 164 preferably having at least one slit 166 disposed therein to minimize eddy current generation around the sense head 160. In one example the sensing head 50 is made of 30 awg magnetic wire, and has the following dimensions:

Sensor Length = 10.5 mm
Sensor Diameter = 16.0 mm
Sensor Core Diameter = 3.1 mm

For the same example, the sensing head 50 has the following electromagnetic properties:

L1 = 5.83 mH
R = 8.89 Ω
Q = 3.78

In an alternative embodiment, the above-described sensing head 50 could be defined by a transformer type sensor in which the primary coil of the transformer is wound with relatively larger wire to handle relatively higher currents while the secondary coil is wound with relatively finer wire to increase sensor sensitivity to small changes in toner concentration.

It has been found that, in contrast to the known sensing arrangement 118, the sensing apparatus 49 can be implemented for the developer units 44–47 with little or no alteration of the structure of the developer housing 102. That is, sensing can be achieved when the sensing head 50 is merely secured conventionally along an outer surface of the housing 102. In one example, the sensing head 50 is mounted to the developer housing 102 with either conventional fasteners or an adhesive. Consequently, there is no need to cut a hole in the developer housing 102 or even bring the sensing head 50 into direct contact with the developer mix 108.

Figure 6A:
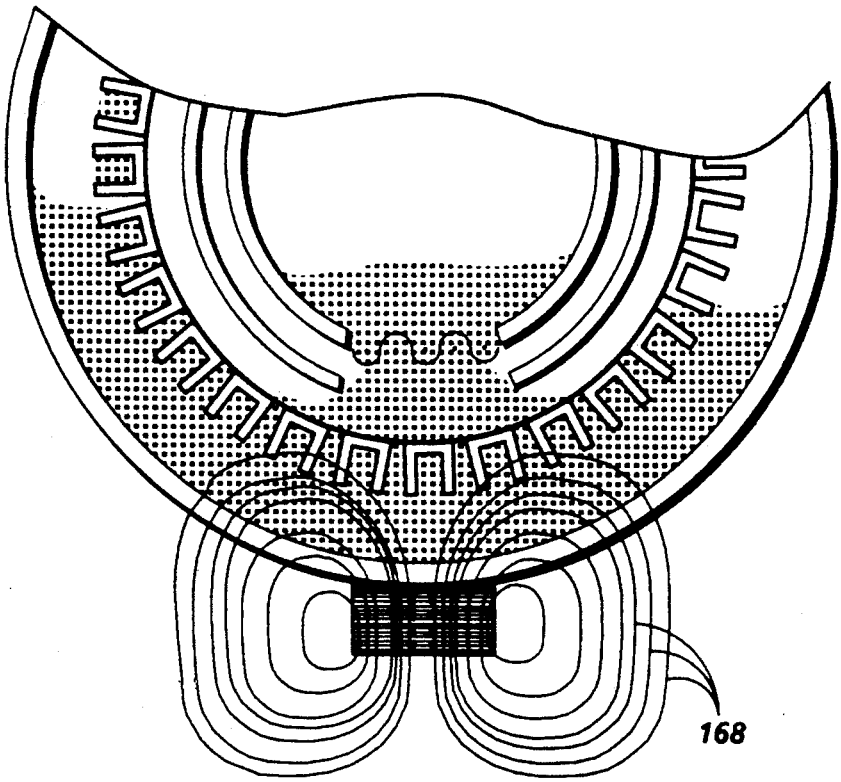
FIG. 6A is a sectional view of the sensing head mounted to an outer surface of the developer unit of FIG. 2, the sensing head transmitting a magnetic field.
Figure 6B:
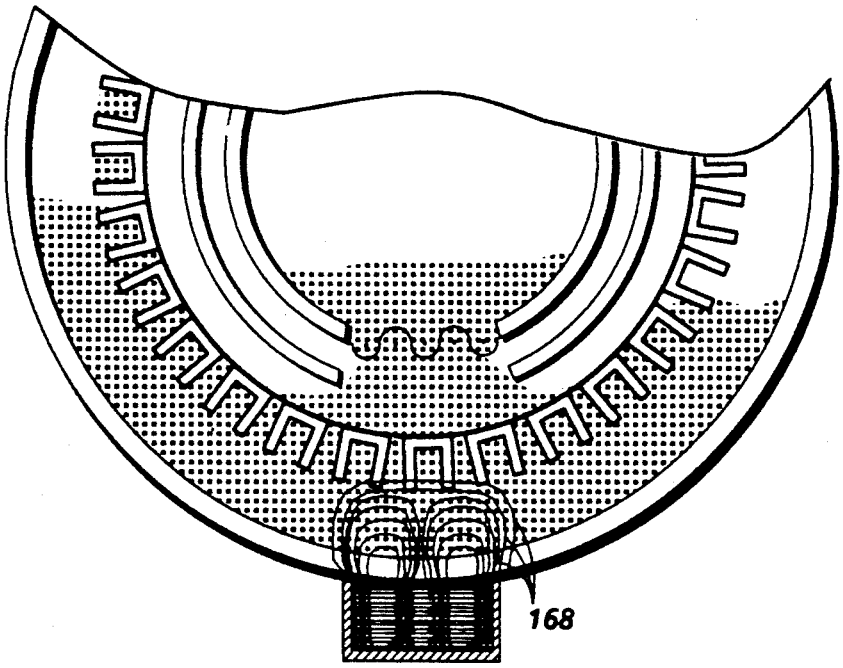
FIG. 6B is a sectional view of the sensing head of FIG. 6A with a shield encompassing a substantial portion thereof.

Referring to FIGS. 6A and 6B, the advantageous effect of the shield 164 can be better understood. In FIGS. 6A and 6B, the sensing head 50 is shown mounted to an outer surface of the developer housing 102. As will be recognized, a magnetic field having an intensity of H can be generated by applying alternating current or pulses to the wire 160. When a magnetic field, having magnetic field lines 168, is generated in the sensing head 50 without the shield 164 (FIG. 6A), the field lines are disposed both inside and outside of the developer housing 102. On the other hand, when the sensing head 50 is used with the shield 164, substantially all of the field lines are "focused" into the developer housing 102. For the respective cases of FIGS. 6A and 6B, when current is held constant, it has been found that the focused field has a significantly greater intensity in the developer housing 102 than does the unfocused field.

Figure 7A:
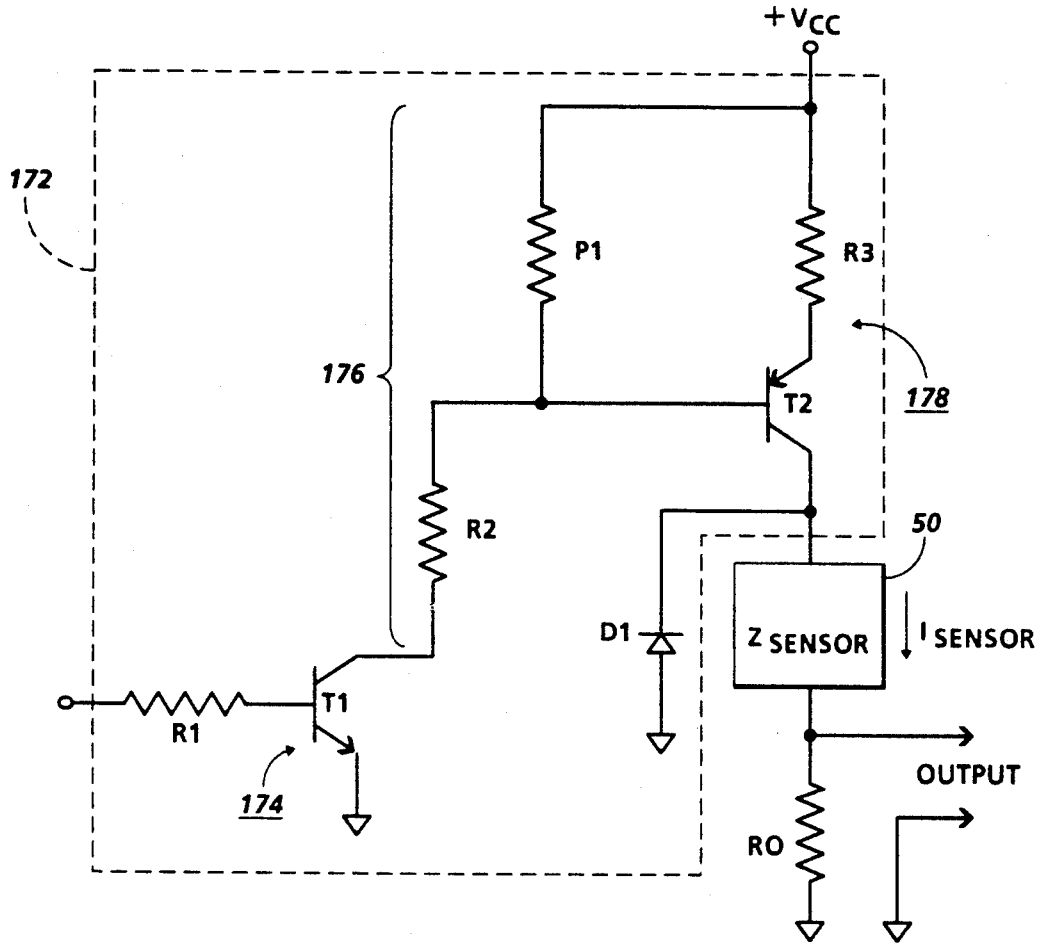
FIG. 7A is a schematic view of a circuit used to drive the sensing head.

Referring to FIG. 7A, a drive circuit for the driving processing network 51 is designated by the numeral 172. The drive circuit 172 includes an arrangement 174 of R1, R2 and T1, the arrangement being adapted to transmit a pulse of a preselected magnitude therethrough. In the preferred embodiment, the pulse is applied to the arrangement 174 by way of a conventional TTL trigger. A potentiometer ("pot"), designated by the term P1, is coupled with the resistor R2 to define a voltage divider 176, the voltage divider 176 setting the maximum current that can flow through the sensing head 50. Current is driven to the sensing head 50 via a current driver arrangement 178, the arrangement 178 including a transistor T2 coupled with a resistor R3. In the illustrated embodiment of FIG. 7A, the sensing head 50 is forward biased with a "free wheel" diode D1, and the output of the sensing head 50 is interconnected with an output resistor RO.

Figure 7B:
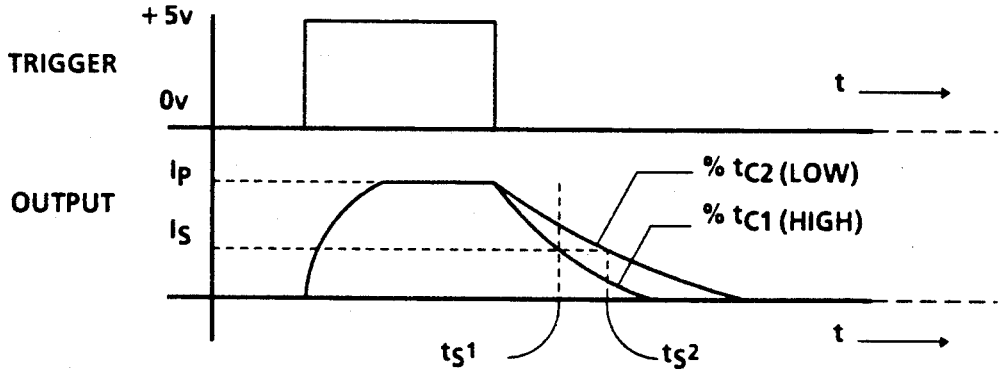
FIG. 7B depicts schematic views of a pulse input for the sensing head and an output transient of the sensing head.

Referring to FIG. 7B, the operation of the current driving operation in described in further detail. After adjusting pot P1, a pulse having a preselected magnitude is inputted to the current driver arrangement 178. As the pulse is applied to the sensing head 50, the current level approaches a maximum level, namely $I_P$. Assuming that the pulse has a magnitude great enough to generate a magnetic field of appropriate intensity H, a preselected volume of the developer mix 108, which developer mix includes magnetic carrier material, is compressed. When the pulse is discontinued, the current output across RO begins to decay in accordance with the relationship:

Current Decay Rate = L/R where,
L = inductance of sensing head 50
R = resistance of D1, Sensor 50 and RO It should be appreciated that the inductance L is increased when placed in proximity with the magnetic carrier material. Indeed current decay rate will vary as a function of the carrier-to-toner ratio in the compressed preselected volume. That is as toner concentration in the developer mix decreases, the relative amount of carrier material increases. Accordingly, as illustrated in FIG. 7B, the slope of the curve of current decay for the developer mix having relatively low toner concentration is less steep than the curve of current decay for developer mix having a relatively high toner concentration.

The magnetic field generated by the sensing head 50 varies in accordance with, among other factors, the dimensions of the sensing head 50 as well as the preferred magnitude of the pulse and the preferred time duration over which the pulse spans. To achieve an optimal magnetic field with the sensing head 50, the magnitude and duration of the pulse should be great enough to generate a magnetic field that adequately compresses the preselected sample over a suitable time interval without wasting excessive amounts of energy.

For the exemplary sensing head 50, whose dimensions were indicated above, it has been found that an appropriate preselected volume of developer mix 108 is compressed for a suitable time interval when the current pulse has a magnitude of about 750 mA and a duration of about 50 msec.

Figure 8A:
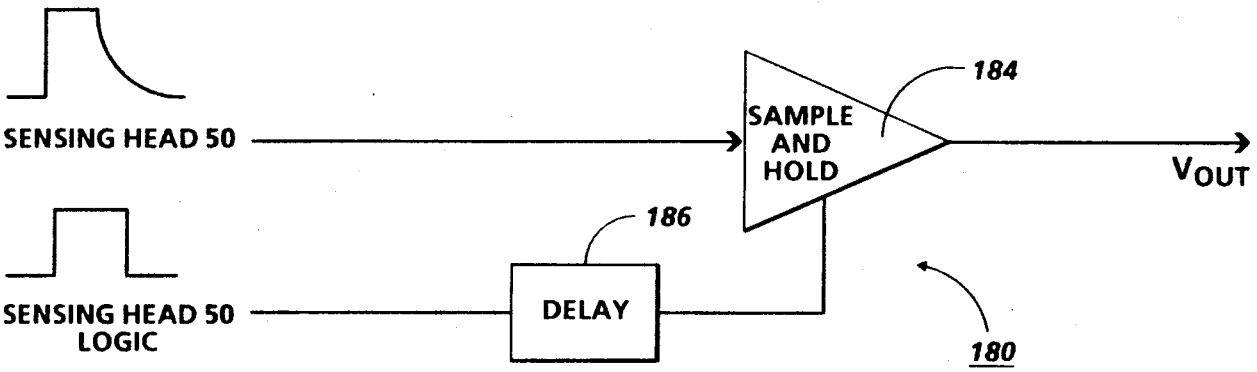
FIGS. 8A and 8B respectively depict schematic views of circuits employed to process the output transient of the sensing head.
Figure 8B:
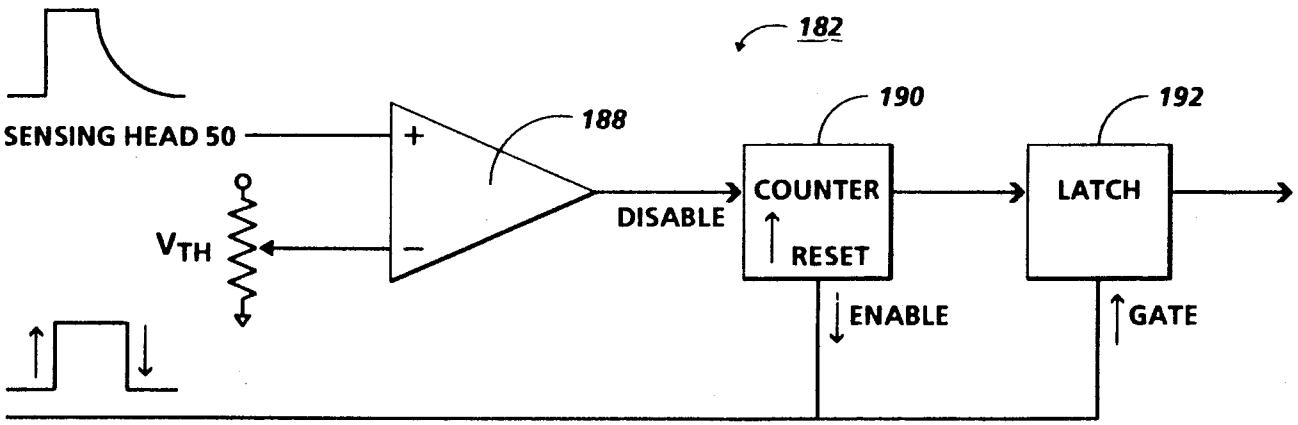

Referring to FIGS. 8A and 8B, processing circuits, adapted for use with the drive circuit 172, are designated by the numerals 180 and 182. Referring specifically to FIG. 8A, the processing circuit comprises a sample and hold device 184, such as an operational amplifier adapted for analog storage. The sample and hold device 184 is operatively coupled with a delay device 186, such as a capacitor or the like. In operation, the output from RO (FIG. 7A) is inputted to the sample and hold device 184 in which it is held for a preselected sampling period, e.g. $t_{S1}$. In the meantime, an enabling signal for the sample and hold device 184 is transmitted to the delay device 186. After $t_{S1}$ has elapsed, the enabling signal is transmitted to the sample and hold device 184 so that a signal indicative of toner concentration, such as $V_{OUT}$, is outputted from the sample and hold device 184.

Figure 9:
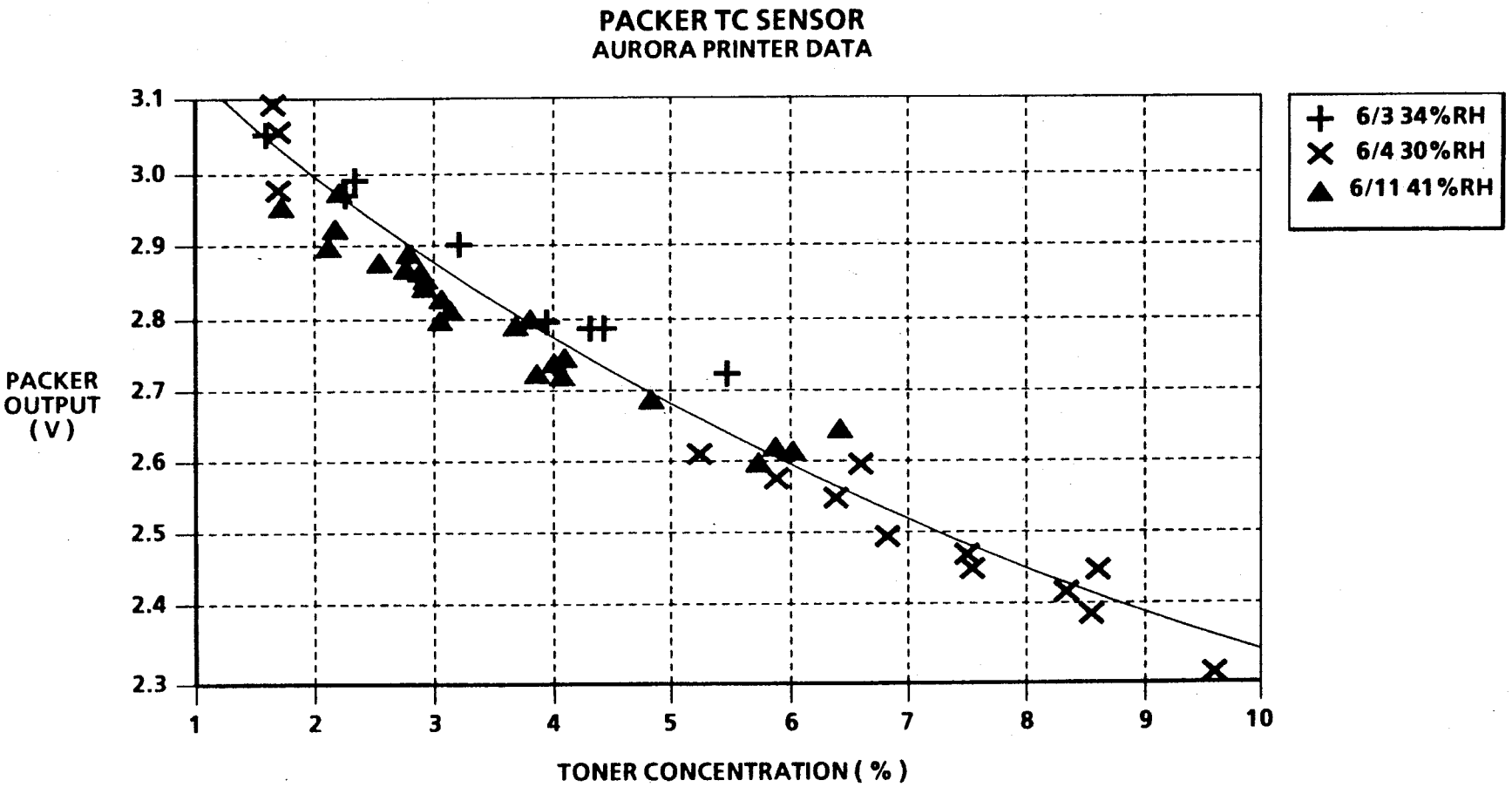
FIG. 9 is a calibration curve correlating voltage outputs from the sensing head with corresponding toner concentration percentages, the calibration curve being constructed from three independent sets of data.

With the aid of an appropriate calibration curve, such as the calibration curve in FIG. 9, the output of the sample and hold device 184, i.e. $V_{OUT}$, can be matched with a corresponding toner concentration percentage. As should be recognized by those skilled in the art, the calibration curve of FIG. 9 can be constructed by successively placing reference samples of varying toner concentration in a suitable container, applying a constant magnetic field to each sample by use of the drive circuit 172, and correlating a voltage for each sample with it respective toner concentration level or percentage.

Referring specifically to FIG. 8B, a digital alternative to the above approach is shown. The processing circuit 182 comprises a comparator 188, such as an operational amplifier ("op amp"), coupled with a counter 190. A noninverting input of the op amp 188 communicates with the output of the drive circuit 172, and an inverting input of the op amp 188 is referenced at a threshold voltage (VTH). Referring again to FIG. 7B, $V_{TH}$ is a voltage corresponding to a current level encountered during decay, such as $I_S$. As shown in FIG. 7B, decay curves for developer mixes of varying toner concentrations will intersect $V_{TH}$ at different locations. The counter 190 is reset on the rising edge of the triggered pulse and enabled on the descending edge of the triggered pulse. A latch 192 is coupled with the counter 190 for latching the output thereof. The latch 192 is gated on the rising edge of the triggered pulse.

In operation, when the pulse is triggered in drive circuit 172, the counter 190 is reset and the previous count is outputted from the latch 192 as it is gated. As the pulse descends, the counter is enabled and the count continues until the current decay, sensed from RO, reaches $V_{TH}$, at which time the counter 190 is disabled. If the count output is desired immediately, it can be obtained by transmitting an appropriate signal to the latch 192. It will be understood from the discussion above that a calibration curve can be constructed to correlate count output with toner concentration. Moreover, it will also be recognized that with the above-described digital approach, the results of the calibration curve can be down-loaded into a look-up table of a microprocessor, the microprocessor being disposed in the electrophotographic printing apparatus described above. With the digital approach, the count output could be transmitted to the microprocessor and matched with a toner concentration percentage reference value from the look-up table. In turn, the value from the look-up table could be stored in a memory and/or displayed via a user interface.

Referring again to FIG. 9, three sets of data, respectively taken at relative humidities of 30%, 34% and 41% are shown. Each set of data was derived by varying toner concentration in a developer mix and analyzing the corresponding current decay as discussed above. Generally, all of the data plots on a single composite calibration curve. Specifically, the composite curve demonstrates the insensitivity of the sensing apparatus to humidity. It follows from experimentation with the sensing apparatus 49 that similar composite curves, demonstrating the insensitivity of the sensing apparatus 49 to, among other factors, developer aging, non-geometric packing fractions and changes in environment, can be constructed.

What is claimed is:

1. A toner concentration sensing apparatus for use with a developer container adapted to retain a quantity of developer material, the developer material including varying concentrations of magnetic carrier material and toner material, said toner concentration sensing apparatus comprising:

means for generating a magnetic field within the developer container;

means for controlling said generating means to generate the magnetic field for a preselected interval within the developer container, wherein a preselected portion of the developer material is compressed by the magnetic field and a signal is generated across said generating means, the signal across said generating means decaying after the preselected interval as a function of the concentration of the toner material; and means, responsive to said controlling means, for monitoring the decay in the signal across said generating means to determine the concentration of the toner material.

2. A toner concentration sensing apparatus for use with a developer container adapted to retain a quantity of developer material, the developer material including varying concentrations of magnetic carrier material and toner material, said toner concentration sensing apparatus comprising:

means for generating a magnetic field within the developer container;

means for controlling said generating means to selectively generate the magnetic field within the developer container, wherein the magnetic field is generated for a preselected interval, wherein a preselected portion of the developer material is compressed by the magnetic field and a signal is generated across said generating means, the signal across said generating means varying as a function of the concentration of the toner material; and means, responsive to said controlling means, for monitoring the variation in the signal across said generating means to determine the concentration of the toner material, wherein the signal across said generating means is a current output, the current output decaying after the preselected interval has ended, and wherein the rate of decay of the current output varies as a function of toner concentration.

3. The apparatus of claim 2, further comprising means for processing the decaying current output to determine when the decaying current output has attained a preselected threshold level.

4. The apparatus of claim 3, wherein said processing means includes means for counting a time interval, the time interval being defined from about after the preselected time interval to about when the decaying current output has attained the preselected threshold level.

5. The apparatus of claim 1, wherein said generating means comprises an inductive element operatively coupled with said controlling means.

6. The apparatus of claim 5, wherein:

said inductive element comprises a coil having a plurality of turns; and the plurality of turns is great enough in number to allow for the compression of the preselected portion of developer material when an electrical pulse is applied to said coil.

7. The apparatus of claim 1, wherein the developer container has an outer surface and said generating means is mounted thereto.

8. The apparatus of claim 1, further comprising means for directing magnetic field lines of the magnetic field, wherein substantially all of the field lines are directed from said generating means into the container to form a strong local magnetic field within the developer container.

9. The apparatus of claim 8, wherein said directing means comprises a shield encompassing a substantial portion of said generating means.

10. The apparatus of claim 1, wherein said controlling means comprises a pulse generator.

11. The apparatus of claim 10, wherein said controlling means further comprises means for driving the pulse from said pulse generator to said generating means.

12. In a printing apparatus of the type having means for developing a latent image disposed on a retentive member, the developing means including a container adapted to retain a quantity of developer material, the developer material having a varying concentration of magnetic carrier material and toner material, an improved toner concentration sensing apparatus comprising:

means for generating a magnetic field within the developer container;

means for controlling said generating means to generate the magnetic field for a preselected interval within the developer container, wherein a preselected portion of the developer material is compressed by the magnetic field and a signal is generated across said generating means, the signal across said generating means decaying after the preselected interval as a function of the concentration of the toner material; and means, responsive to said controlling means, for monitoring the decay in the signal across said generating means to determine the concentration of the toner material.

13. In a printing apparatus of the type having means for developing a latent image disposed on a retentive member, the developing means including a container adapted to retain a quantity of developer material, the developer material having a varying concentration of magnetic carrier material and toner material, an improved toner concentration sensing apparatus comprising:

means for generating a magnetic field within the developer container;

means for controlling said generating means to selectively generate the magnetic field within the developer container, wherein the magnetic field is generated for a preselected interval, wherein a preselected portion of the developer material is compressed by the magnetic field and a signal is generated across said generating means, the signal across said generating means varying as a function of the concentration of the toner material; and means, responsive to said controlling means, for monitoring the variation in the signal across said generating means to determine the concentration of the toner material, wherein the signal across said generating means is a current output, the current output decaying after the preselected interval has ended, and wherein the rate of decay of the current output varies as a function of toner concentration.

14. The printing apparatus of claim 13, further comprising means for processing the decaying current output to determine when the decaying current output has attained a preselected threshold level.

15. The printing apparatus of claim 14, wherein said processing means includes means for counting a time interval, the time interval being defined from about after the preselected time interval to about when the decaying current output has attained the preselected threshold level.

16. The printing apparatus of claim 12, wherein said generating means comprises an inductive element operatively coupled with said controlling means.

17. The printing apparatus of claim 16, wherein:

said inductive element comprises a coil having a plurality of turns; and the plurality of turns is great enough in number to allow for the compression of the preselected portion of developer material when an electrical pulse is applied to said coil.

18. The printing apparatus of claim 12, wherein the developer container has an outer surface and said generating means is mounted thereto.

19. The printing apparatus of claim 12, further comprising means for directing magnetic field lines of the magnetic field, wherein substantially all of the field lines are directed from said generating means into the container to form a strong local magnetic field within the developer container.

20. The printing apparatus of claim 19, wherein said directing means comprises a shield encompassing a substantial portion of said generating means.

21. The printing apparatus of claim 12, wherein said controlling means comprises a pulse generator.

22. The printing apparatus of claim 21, wherein said controlling means further comprises means for driving the pulse from said pulse generator to said generating means.

23. A method for sensing toner concentration in a container adapted to retain developer material, the developer material including varying concentrations of magnetic carrier material and toner material, said method comprising the steps of:

applying a signal to means for generating a magnetic field for a preselected time interval to selectively generate a magnetic field in the developer container, wherein a minor preselected portion of the developer material is compressed and the signal across said generating means decays as a function of the concentration of the toner material; and monitoring the decay of the signal to determine the concentration of the toner material.

24. The method of claim 23, wherein the generating means comprises an inductive element, and wherein the applying step comprises driving a pulse through the inductive element to generate the magnetic field.

25. A method for sensing toner concentration in a container adapted to retain developer material, the developer material including varying concentrations of magnetic carrier material and toner material, said method comprising the steps of:

applying a signal to means for generating a magnetic field for a preselected time interval to selectively generate a magnetic field in the developer container, wherein a minor preselected portion of the developer material is compressed and the signal across said generating means varies as a function of the concentration of the toner material, and wherein the signal across said generating means has a current output, the current output decaying after the preselected interval has ended, and the rate of decay of the current output varying as a function of toner concentration; and monitoring the variation in the signal to determine the concentration of the toner material, wherein the monitoring step comprises the step of processing the decaying current output to determine when the decaying current output has attained a preselected threshold level.

* * * * *